US008439512B2

(12) United States Patent
Isogai et al.

(10) Patent No.: US 8,439,512 B2
(45) Date of Patent: May 14, 2013

(54) SEMICONDUCTOR LAMP WITH WAVELENGTH CONVERTER AND CIRCUIT COMPONENT AXIALLY OPPOSED FROM LIGHT SOURCE

(75) Inventors: Toshiaki Isogai, Osaka (JP); Yasuhisa Ueda, Osaka (JP); Kazushige Sugita, Hyogo (JP); Hideo Nagai, Osaka (JP); Takaari Uemoto, Osaka (JP); Masahiro Miki, Osaka (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 13/392,047

(22) PCT Filed: Sep. 1, 2011

(86) PCT No.: PCT/JP2011/004913

§ 371 (c)(1), (2), (4) Date: Feb. 23, 2012

(87) PCT Pub. No.: WO2012/049803

PCT Pub. Date: Apr. 19, 2012

(65) Prior Publication Data

US 2012/0275145 A1 Nov. 1, 2012

(51) Int. Cl.
*F21V 9/16* (2006.01)
*H01J 63/06* (2006.01)

(52) U.S. Cl.
USPC ..... 362/84; 362/230; 362/240; 362/242; 362/243; 362/249.02; 313/498; 313/500

(58) Field of Classification Search ..... 362/545, 362/84, 646, 230, 240, 242, 243, 249.02; 313/498, 313/500
See application file for complete search history.

(56) References Cited

U.S. PATENT DOCUMENTS

| | | | |
|---|---|---|---|
| 2006/0227558 | A1 | 10/2006 | Osawa et al. |
| 2009/0086492 | A1 | 4/2009 | Meyer |
| 2009/0302730 | A1 | 12/2009 | Carroll et al. |
| 2010/0237761 | A1 | 9/2010 | Osawa et al. |
| 2010/0237779 | A1 | 9/2010 | Osawa et al. |
| 2010/0244650 | A1 | 9/2010 | Osawa et al. |
| 2010/0244694 | A1 | 9/2010 | Osawa et al. |
| 2010/0253200 | A1 | 10/2010 | Osawa et al. |
| 2010/0277069 | A1 | 11/2010 | Janik et al. |
| 2011/0156569 | A1 | 6/2011 | Osawa |
| 2011/0309386 | A1 | 12/2011 | Osawa et al. |
| 2011/0310606 | A1 | 12/2011 | Osawa et al. |
| 2012/0001545 | A1 | 1/2012 | Carroll et al. |

FOREIGN PATENT DOCUMENTS

| | | |
|---|---|---|
| JP | 2003-151305 | 5/2003 |
| JP | 2004-214036 | 7/2004 |
| JP | 2005-222750 | 8/2005 |
| JP | 2006-313717 | 11/2006 |
| WO | 2009/089529 | 7/2009 |
| WO | 2009/149263 | 12/2009 |

*Primary Examiner* — Ismael Negron

(57) ABSTRACT

A lamp includes a semiconductor light-emitting element, a light guiding element, a wavelength converter, a reflecting mirror, and a circuit unit axially disposed within a central section of the outer tube of an envelope. Light emitted by the semiconductor light-emitting element is guided by the light guiding element to be incident on and be converted by the wavelength converter. At least one component of the circuit unit is disposed at a side of the wavelength converter opposite the semiconductor light-emitting element. The reflecting mirror is disposed between the at least one component of the circuit unit and the wavelength converter, and reflects at least part of light received from the wavelength converter back toward the wavelength converter.

8 Claims, 6 Drawing Sheets

SEMICONDUCTOR LAMP WITH WAVELENGTH CONVERTER AND CIRCUIT COMPONENT AXIALLY OPPOSED FROM LIGHT SOURCE

RELATED APPLICATIONS

The present application claims priority from Japanese PCT/JP 2011/004913 filed on Sep. 1, 2011, which claims priority from Japanese Application No. 2010-229854 filed on Oct. 12, 2010.

TECHNICAL FIELD

The present invention generally relates to lamps having a semiconductor light-emitting element, such as a light-emitting diode (LED), as a light source. In particular, the present invention relates to an LED lamp for replacing a high-intensity discharge (HID) lamp.

BACKGROUND ART

With the commercialization of high-intensity LEDs, recent years have seen the widespread use of LED lamps having an LED module as a light source. As one example, Patent Literature 1 discloses an LED lamp as a replacement for an incandescent lamp. The LED lamp disclosed has an LED module as a light source and a circuit unit for causing the LED module to emit light. The LED module and the circuit unit are housed in an envelope generally composed of a globe and a base. The circuit unit is disposed between the LED module and the base so as not to obstruct light emitted by the LED module.

CITATION LIST

Patent Literature

[Patent Literature 1]
Japanese Patent Application Publication No. 2006-313717

SUMMARY OF INVENTION

Technical Problem

Unfortunately, the above-described arrangement of the circuit unit naturally means that the circuit unit is located on the path of heat conduction from the LED module to the base, which involves the risk of thermally damaging electronic components and thus leads to reduction of lamp life.

In particular, to use an LED lamp in place of an HID lamp having higher intensity than incandescent lamps, it is necessary to use a larger number of LEDs or place a larger current to achieve a comparable level of intensity. In such a case, the amount of heat generated by the LED modules naturally increases, which makes the risk of thermally damaging electronic components more serious.

In addition, the following needs to be noted. That is, HID lamps have light distribution characteristics similar to those of a point light source and are configured to emit light mainly from an axially central section of the outer tube. By simply employing a configuration according to which light exits from the entire globe (corresponding to the outer tube of an HID lamp) as in the case of the LED lamp disclosed in Patent Literature 1, the resulting lamp fails to achieve light distribution characteristics similar to those of HID lamps.

The present invention is made in view of the problems noted above and aims to provide a lamp involving little risk of thermally damaging electronic components of the circuit unit and configured to emit light mainly from the axially central section of the outer tube.

Solution to Problem

In order to solve the problems noted above, a lamp according to one aspect of the present invention includes a semiconductor light-emitting element as a light source, a circuit unit configured to cause the semiconductor light-emitting element to emit light, and an envelope having an outer tube and a base. The semiconductor light-emitting element and the circuit unit are housed in the envelope. The lamp includes a wavelength converter disposed in an axially central section of the outer tube and configured to convert wavelengths of light incident thereto. The semiconductor light-emitting element is disposed in a region at a side of the wavelength converter facing the base and oriented so that a main emission direction points away from the base. The lamp also includes: an optical component disposed between the wavelength converter and the semiconductor light-emitting element and configured to guide emission light of the semiconductor light-emitting element to the wavelength converter; and a reflecting mirror configured to reflect light. At least one component of the circuit unit is disposed in a region at a side of the wavelength converter opposite the semiconductor light-emitting element. The reflecting mirror is disposed between the at least one component of the circuit unit and the wavelength guide and reflects light received from the wavelength converter back toward the wavelength converter.

Advantageous Effects of Invention

In the lamp according to the above aspect of the present invention, the semiconductor light-emitting element is disposed in a region at a side of the wavelength converter facing the base, and at least one component of the lighting unit is disposed in a region at a side of the wavelength converter opposite the semiconductor light-emitting element. Being disposed in the region at the side of the wavelength converter opposite the semiconductor light-emitting element, the at least one component of the circuit unit is not on the path heat conduction from the semiconductor light-emitting element to the base. Consequently, there is little risk of thermally damaging electronic components. Therefore, the lamp is ensured to have a long life.

In addition, the wavelength converter that converts the wavelengths of light incident thereto is disposed in the axially central section of the outer tube, the semiconductor light-emitting element has the main emission direction oriented away from the base, and an optical component that guides light emitted by the semiconductor light-emitting element to the wavelength converter is disposed between the wavelength converter and the semiconductor light-emitting element. Owing to the above, light emitted by the semiconductor light-emitting element is guided by the optical component to the wavelength converter where wavelengths of part of the light are converted. As a result, a combination of light directly emitted by the semiconductor light-emitting element and light converted inside the wavelength converter exits from the wavelength converter. In other words, since a combination of different colors of light exits from the axially central section of the outer tube, the axially central section is mainly where light shines. Thus, the light distribution characteristics similar to an HID lamp are achieved.

Here, it is noted that arranging at least one component of the lighting unit in the light emission direction as above involves the risk of obstructing and thus decreasing light emitted to the outside of the lamp.

To address this risk, the lamp according to the above aspect of the present invention is provided with the reflecting mirror disposed between the at least one component of the lighting unit and the wavelength converter. The reflecting mirror reflects at least part of light received from the wavelength converter back toward the wavelength converter. That is, by the presence of the reflecting mirror, light that would otherwise reach and be absorbed by the at least one component of the lighting unit disposed in a region at the side opposite the semiconductor light-emitting element is reflected back toward the wavelength converter. The reflected light is scattered within the wavelength converter thorough the process of wavelength conversion, for example. As a result, at least part of the reflected light comes out of the outer tube. This helps to reduce loss of the amount of light emitted to the outside the outer tube.

DESCRIPTION OF EMBODIMENTS

The following describes lamps according to embodiments of the present invention, with reference to the drawings. Note that the specifics, such as materials and numeric values, mentioned in the embodiments are given merely by way of preferable examples and without limitation. Various modifications may be made without departing from the technical concept of the Present invention. Furthermore, one or more structural components of different embodiments may be combined unless a contradiction arises.

In addition, although an LED is specifically mentioned as a semiconductor light-emitting element, other semiconductor light-emitting elements are duly usable. Non-limiting examples of a usable semiconductor light-emitting element include a laser diode (LD) and an electroluminescence (EL) element.

Embodiment 1

[General Structure]

Figure 1:
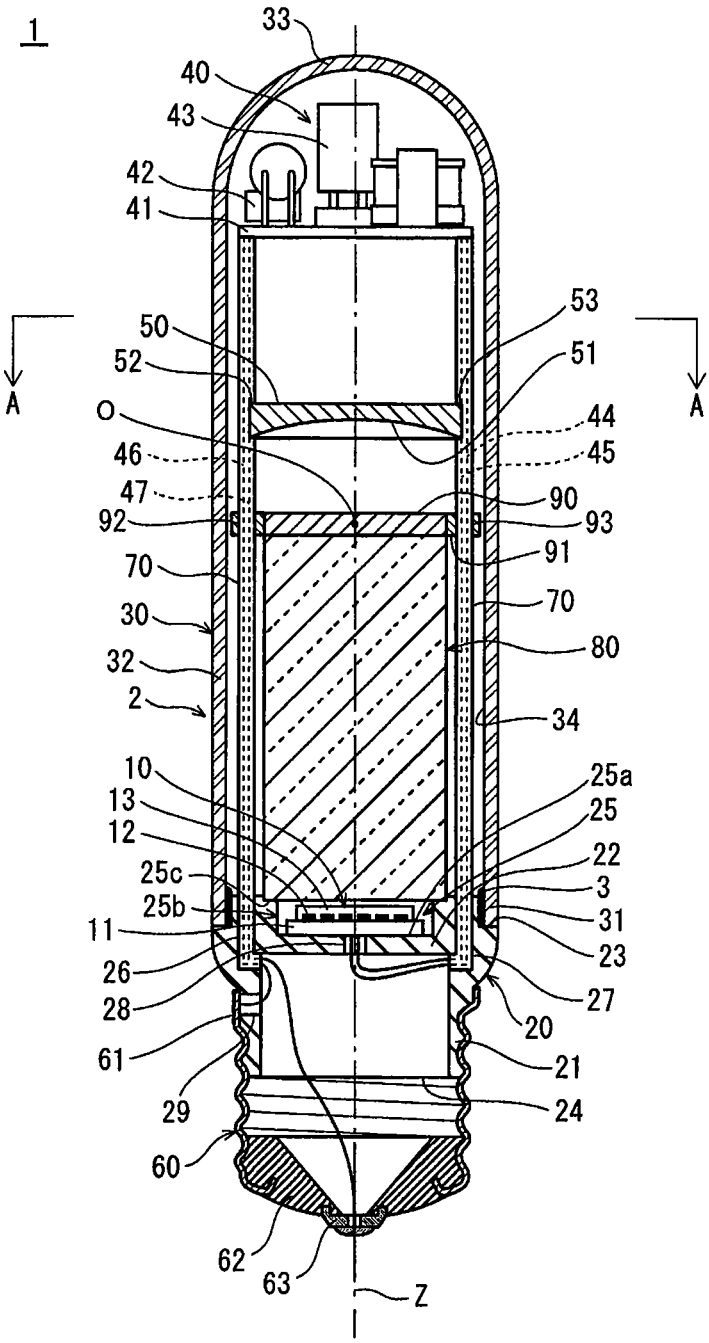
FIG. 1 is a longitudinal cross-sectional view showing a structure of an LED lamp according to Embodiment 1.
Figure 2:
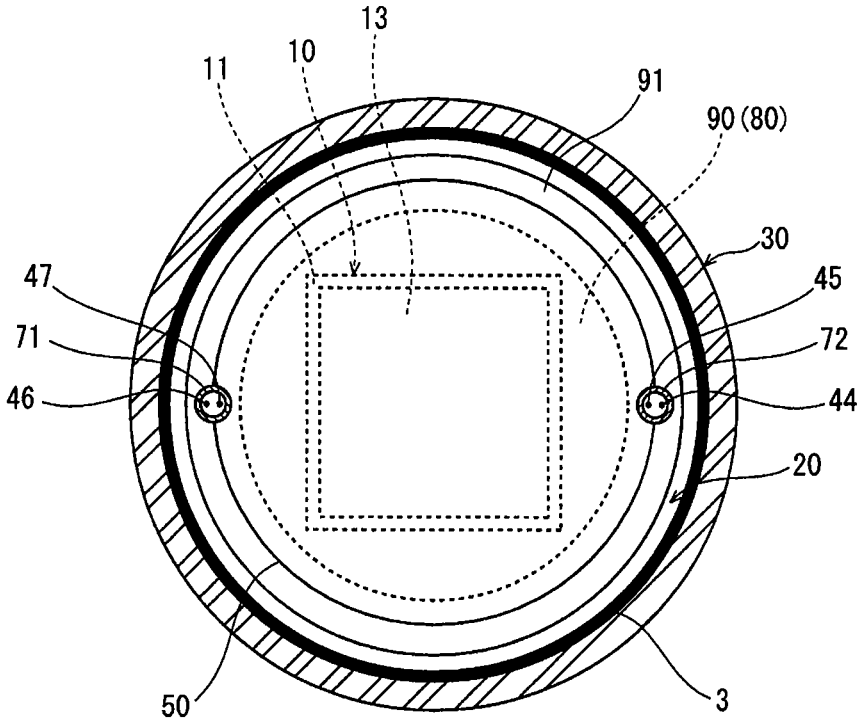
FIG. 2 is a cross-sectional view taken along line A-A in FIG. 1, looking in the direction of the appended arrows.

FIG. 1 is a longitudinal cross-sectional view showing the structure of an LED lamp according to Embodiment 1. FIG. 2 is a cross-sectional view taken along line A-A in FIG. 1, looking in the direction of the appended arrows.

As shown in FIG. 1, the LED lamp (corresponding to "lamp" of the present 10 invention) 1 according to Embodiment 1 is usable as a replacement for an HID lamp and includes: an LED module 10 as a light source; a mount 20 on which the LED module 10 is mounted; an outer tube 30 housing the LED module 10; a circuit unit 40 for causing the LED module 10 to emit light; a light guide 80 that is an optical component for guiding light received from the LED module 10 toward a wavelength converter 90; the wavelength converter 90 for wavelength conversion of light incident thereto; a reflecting mirror 50 for reflecting back at least part of light received from the wavelength converter 90; and a base 60 electrically connected to the circuit unit 40.

To put it into another way, the lamp 1 is configured such that the LED module 10 and the circuit unit 40 are housed in an envelope 2 composed generally of the mount 20, the outer tube 30, and the base 60. The wavelength converter 90 for converting the wavelengths of incident light is disposed inside the outer tube 30 at a location coinciding with an axially central section of the outer tube 30. The LED module 10 is disposed in a region of the outer tube 30 at a side of the wavelength converter 90 facing the base 60 (i.e., the LED module 10 is disposed between the wavelength converter 90 and the base 60). In addition, the LED module 10 is oriented to have the main emission direction away from the base 60. The light guide 80 is located between the wavelength converter 90 and the LED module 10 so that light received from the LED module 10 is guided to the wavelength converter 90. The circuit unit 40 is disposed in a region of the outer tube 30 at a side of the wavelength converter 90 opposite the LED module 10. The reflecting mirror 50 is disposed between the circuit unit 40 and the wavelength converter 90, so that that at least part of light received from the wavelength converter 90 is reflected back toward the wavelength converter 90.

[Respective Components]

(1) LED Module

The LED module 10 has a mounting substrate 11, a plurality of LEDs 12 that serve as a light source and that are mounted on the surface of the mounting substrate 11, and a sealer 13 that is disposed on the mounting substrate to encapsulate the LEDs 12. The sealer 13 is made from a translucent material, and silicone resin is one example of such a material.

In addition, the color of light emitted by the LEDs 12 used in this embodiment is blue (hereinafter, such an LED is referred to as a "blue LED").

(2) Mount

The mount 20 has the shape of a bottomed tube. More specifically, the mount 20 is generally composed of a tubular member 21 having a circular cylindrical shape and a closure 22 having a circular plate shape and extending from one end of the tubular member 21 to constitute the bottom. The closed end of the tubular member 21 is located nearer to the circuit unit 40. In the outer circumferential surface along the end nearer to the circuit unit 20, the mount 20 has a circumferentially extending recess 23 for engagement with an open end portion 31 of the outer tube 30. The open end portion 31 is received by the recess 23 and is secured thereto by adhesive 3, so that the mount 20 is bonded to the outer tube 30. The base 60 is fitted over the other end of the mount 20 away from the circuit unit 40 to close off the end of the tubular member 21.

The closure 22 has a depressed portion 25 at a location centrally of the end thereof facing toward the circuit unit 40. The LED module 10 is mounted on the inner bottom surface 25*a* of the depressed portion 25 in such a position that the main emission direction is pointed to the direction opposite to the base 60 (i.e., to the direction toward the wavelength converter 90). The LED module 10 is secured to the mount 20 by, for example, screws, adhesive, or engaging structure. Heat generated during the operation of the LEDs 12 is transferred through the mount 20 to the base and then to a lighting fixture (not illustrated).

An inner circumferential wall 25*b* of the recessed portion 25 has a stepped portion 25*c*. The light guide, which will be detailed later, is secured along the 15 stepped portion 25*c* by adhesive.

(3) Outer Tube

The outer tube 30 has the shape of a bottomed tube. More specifically, the outer tube 30 is generally composed of a tubular portion 32 having a circular cylindrical shape and a top portion 33 having a hemispherical shape and extending from one end of the tubular member 21 to constitute the bottom. The shape (type) of the outer tube 30 is not particularly limited. In the present embodiment, the outer tube 30 is of a straight-type similar to an outer tube of a straight-tube type HID lamp. Note that the outer tube 30 is not limited to an outer tube having one open and one closed end. Alternatively, an outer tube having two open ends may be used.

In the present embodiment, the outer tube 30 is colorless transparent and made of a translucent material, such as glass, ceramics, or resin. Light incident on the inner surface 34 of the outer tube 30 exits to the outside by passing through the outer tube 30 without being scattered. Note that the outer tube 30 is not necessarily colorless transparent and may alternatively be colored transparent. In addition, the inner surface 34 of the outer tube 30 may be processed to provide coating of for example, silica or white pigment to impart light-diffusing properties, so that light emitted from the LED module 10 is diffused.

(4) Circuit Unit

The circuit unit 40 includes a disc-shaped circuit substrate 41 and electronic components 42 and 43 mounted on the circuit substrate 41. The surface of the circuit substrate 41 on which the electronic components 42 and 43 are mounted faces away 10 from the base 60. In the figures, only some of the electronic components are identified with reference signs. However, there are other electronic components not bearing reference signs.

The circuit unit 40 is supported by a pair of supports 70 and located within the top portion 33 of the outer tube 30. The circuit substrate 41 is bonded to one end of each of the supports, so that the circuit substrate 41 is secured to the supports 70. It should be noted that the way of securing the circuit unit 40 to the supports 70 is not limited to the one described above. The securing may be accomplished with screws or engaging structure.

The circuit unit 40 is located within the top portion 33, which is at a remote end of the outer tube 30 from the LED module 10. This ensures to suppress conduction of heat from the LEDs 12 to the circuit unit 40, thereby reducing the risk of thermally damaging the electronic components 42 and 43 of the circuit unit 40.

Preferably, in addition, the electronic component 43, which is the tallest of all the electronic components constituting the circuit unit 40, is located centrally of the circuit substrate 41. With such an arrangement, the circuit unit 40 is housed inside the top portion of the outer tube 30 in a space saving manner and at a location farthest away from the LED module 10.

(5) Light Guide

The light guide 80 is made from, for example, acrylic resin and having a columnar shape (circular cylindrical in this example). Note, however, the acrylic resin is not the only example, and any other translucent material may be used to form the light guide 80.

The light guide 80 is secured to the mount 20 by bonding one end of the light guide 80 to the stepped portion 25*c* by adhesive. In this state, one of the end surfaces of the light guide 80 faces the light-emitting surface of the LED module 10, and therefore the end surface functions as an entrance surface.

On the other end surface of the light guide 80, a later-described wavelength converter is disposed. This other end surface of the light guide 80 is in direct contact with one of the surfaces of the wavelength converter 90 facing toward the light guide 80. In addition, the lateral surface of the light guide 80 is coated with a reflecting-film. The reflecting-film is formed, for example, of a deposition film of aluminum. As a consequence, light enters into the light guide 80 from the entrance surface thereof is repeatedly reflected within the light guide 80 to be ultimately guided to the wavelength converter 90.

(6) Wavelength Converter

The wavelength converter 90 is made from a translucent material mixed with a light wavelength converting material. In one example, the wavelength converter 90 has a plate-like shape (disc shape in this embodiment). Similarly to the sealer 13, silicone resin is usable as one example of a translucent material. In addition, phosphor particles are usable as one example of the light-wavelength converting material.

In this embodiment, phosphor particles having a property of converting blue light into yellow light is used as a wavelength converting material. Owing to this arrangement, the wavelength converter 90 emits white light which is a combination of blue light directly emitted by the LEDs 12 and yellow light resulting from the wavelength conversion by the phosphor particles. That is, white light is radiated from the wavelength converter 90, and such distribution characteristics are similar to the light distribution characteristics of an HID lamp.

(7) Plate

A plate 91 is made from a translucent material, and examples of such a material include glass, ceramics, and resin. As shown in FIG. 2, the plate 91 has an opening and a portion surrounding the opening (in this embodiment, the plate 91 has an annular shape). The wavelength converter 90 is fitted in the opening. The wavelength converter 90 and the plate 91 are bonded together by, for example, adhesive, in the state where the wavelength converter 90 is fitted in the opening of the plate 91.

Since the plate 91 is made from a translucent material, white light emitted from the wavelength converter 90 passes through the plate 91 without being blocked.

In addition, the plate 91 has a pair of through holes 92 and 93 for the pair of supports 70 to pass through. At the through holes 92 and 93, the supports 70 are secured to the plate 91 with adhesive, so that the plate 91 comes to be supported by the pair of supports 70.

(8) Reflecting Mirror

The reflecting mirror 50 has a concaved reflecting surface 51 and supported by the pair of supports 70 so that the reflecting surface 51 faces toward the wavelength converter 90.

The reflecting mirror 50 has two engaging grooves 52 and 53 formed in the outer periphery thereof. The engaging grooves 52 and 53 are for engagement with the supports 70 and extend in a direction along the lamp axis Z. In the state where the supports 70 are received within the engaging grooves 52 and 53, adhesive is poured into the grooves 52 and 53. As a result, the reflecting mirror 50 is secured to the pair of supports 70. As above, the reflecting mirror 50 is secured at two locations, using both the engaging structure and adhesive. Therefore, the risk of accidental detachment of the reflecting mirror 50 from the pair of supports 70 is little. Note that the way to fix the reflecting mirror 50 to the pair of supports 70 is not limited to that described above. Similarly to the way to fix the plate 91 to the supports, the reflecting mirror 50 may have through holes and the pair of supports may be received and secured within the through holes. Alternatively, the reflecting mirror 50 may be fixed to the pair of supports with screws.

With the reflecting mirror 50 having the reflecting surface 51, most of light reaching the reflecting mirror 50 is reflected back toward the wavelength converter 90. Note that light reflected from the reflecting mirror 50 and then received by the wavelength converter 90 contains light transmitted without wavelength conversion by the wavelength converter 90 as well as light having been converted by the wavelength converter 90. Of the reflected light received again by the wavelength converter 90, part of light not yet converted is converted by the wavelength converter 90 and scattered. On the other hand, light having been already converted is diffusely reflected in the wavelength converter 90 to exit from the wavelength converter 90, without any further wavelength conversion. As described above, by the presence of the reflecting mirror 50, light incident to the reflecting mirror 50 is reflected back toward the wavelength converter 90, instead of reaching the circuit unit 40 to be absorbed thereby. At least part of the reflected light having reached the wavelength converter 90 undergoes wavelength conversion and diffused reflection to ultimately exits from the outer tube 30. Consequently, loss of an amount of light exiting from the outer tube 30 is reduced.

In addition, the reflecting mirror 50 is disposed between the circuit unit 40 and the wavelength converter 90 and at a location closer to the wavelength converter 90 than to the circuit unit 40. More specifically, the reflecting mirror 50 is located in the axially central section of the outer tube, which will be described later. Since the wavelength converter 90 and the reflecting minor 50 are disposed closed to each other as described above, the resulting light distribution characteristics are closer to that of a point light source.

(9) Base

The base 60 is for receiving power supply from the socket of a lighting fixture when the lamp 1 is attached to the lighting fixture and operated. The base 60 is not limited to any specific type. In this embodiment, E26 Edison base is used. The base 60 is composed of a shell portion 61 and an eyelet portion 63. The shell portion 61 is tubular in shape and has an externally threaded circumferential surface, whereas the eyelet portion 63 is attached to the shell portion 61 via an insulating material 62.

(10) Supports

Each support 70 is a tubular member having the shape of a circular cylinder and made of glass, metal or resins, for example. One end of each support is fixed to the circuit unit 40 and the other end is inserted and bonded in a corresponding one of the through holes 26 and 27 formed in the closure 22 of the mount 20.

More specifically, one end of each support 70 is secured to the circuit unit 40 by adhesive or the like, which results in that the supports 70 are thermally connected to the circuit unit 40. In addition, the other end of each support 70 is bonded to the closure 22, which results in that the supports 70 are thermally connected to the base 60 via the closure 22. This arrangement ensures heat released from the circuit unit 40 to be effectively transferred to the base 60 via the respective supports 70.

As shown in FIG. 2, the supports 70 are disposed to face each other across the LED module 10 with the lamp axis Z in the middle. This arrangement helps to ensure that that the pair of supports 70 do not block light emitted from the LED module 10 and that the circuit unit 40, the plate 91 and the reflecting mirror 50 are supported in balance. Since the circuit unit 40, the plate 91, and the reflecting mirror 50 are all supported by the common supports, an increase in the number of components required is avoided. Note, in addition, that the number of supports 71 is not limited to two, and only one support or three or more supports may be used. In the present embodiment, although the circuit unit 40, the plate 91, and the reflecting mirror 50 are all commonly supported by the supports 70, they may by supported by separate supports.

The supports 70 may be made of a transparent material, which further helps to avoid light emitted by the LEDs 12 being blocked by the supports 70. Alternatively, the supports 70 may be made of a material not transparent. In such a case, the outer surfaces of the supports 70 may be processed to have a mirror finish to improve reflectivity. This arrangement helps to ensure that the supports 70 do not absorb light emitted by the LEDs 12.

Instead of the shape of a circular cylinder, each support 70 may be a tubular member of any other shape such as prismatic. In addition, each support 70 may be a solid cylinder or solid prism instead of a tubular (i.e., hollow) member. When the supports 70 are solid, electrical wiring lines 44-47, which will be described later, may be wound around the respective supports 70 or disposed to extend along the respective supports 70.

An output terminal of the circuit unit 40 is electrically connected to an input terminal of the LED module 10 via the wiring lines 44 and 45. The wiring lines 44 and 45 extending from the circuit unit 40 pass through the interior passage of one of the supports 70 to reach a location closer to the base 60 than the closure 22 of the mount 20 is. The wiring lines 44 and 45 are then turned back to pass through a through hole 28 formed in the closure 22 and connected to the LED module 10.

An input terminal of the circuit unit 40 is electrically connected to the base 60 via the wiring lines 46 and 47. The wiring lines 46 and 47 extending from the circuit unit 40 pass through the interior passage of the other one of the supports 70 to reach a location closer to the base 60 than the closure 22 of the mount 20 is. The wiring line 46 further extends to pass through a through hole 29 formed in the tubular member 21 of the mount 20 and is connected to the shell portion 61 of the base 60. On the other hand, the wiring line 47 further extends through an open end 24 of the tubular member 21 facing toward the base 60 and is connected to the eyelet portion 63 of the base 60.

Note that the electrical wiring lines 44-47 used in this embodiment are insulated leads.

Alternatively to the supports 70, the wiring lines 44-47 of a larger diameter may be used to support the circuit unit 40, the plate 91, and the reflecting mirror 50. In that case, the wiring lines 44-47 serve also as the supports, and thus the circuit unit 40, the plate 91, and the reflecting mirror 50 are secured to the wiring lines 44-47.

[Positional Relation Between LED Module 10, Light Guide 80, Wavelength Converter 90, and Reflecting Mirror 50]

As shown in FIG. 2, the LED module 10 is located directly below the light guide 80 in plan view of the lamp 1 (i.e., when the lamp 1 is seen from the direction opposite to the base 60 along the lamp axis Z, i.e., when the lamp 1 is seen from the top to the bottom in FIG. 2). Thus, the LED module 10 is completely hidden below the light guide 80. Consequently, substantially entire light emitted by the LED module 10 in the main emission direction (in the directly upward direction in FIG. 2) is received by the light guide 80 and guided to the wavelength converter 90.

As described above, the reflecting mirror 50 is located in a vicinity of the wavelength converter 90. In the axial direction, in addition, the area occupied by the wavelength converter 90 falls entirely within the area occupied the reflecting mirror 50. That is, the outer edge of the reflecting mirror 50 is larger than the outer edge of the wavelength converter 90. Owing to this arrangement, light released from the wavelength converter 90 is blocked by the reflecting mirror 50, so that the light is prevented from being absorbed by the circuit unit 40.

[Axially Central Section]

Figure 3:
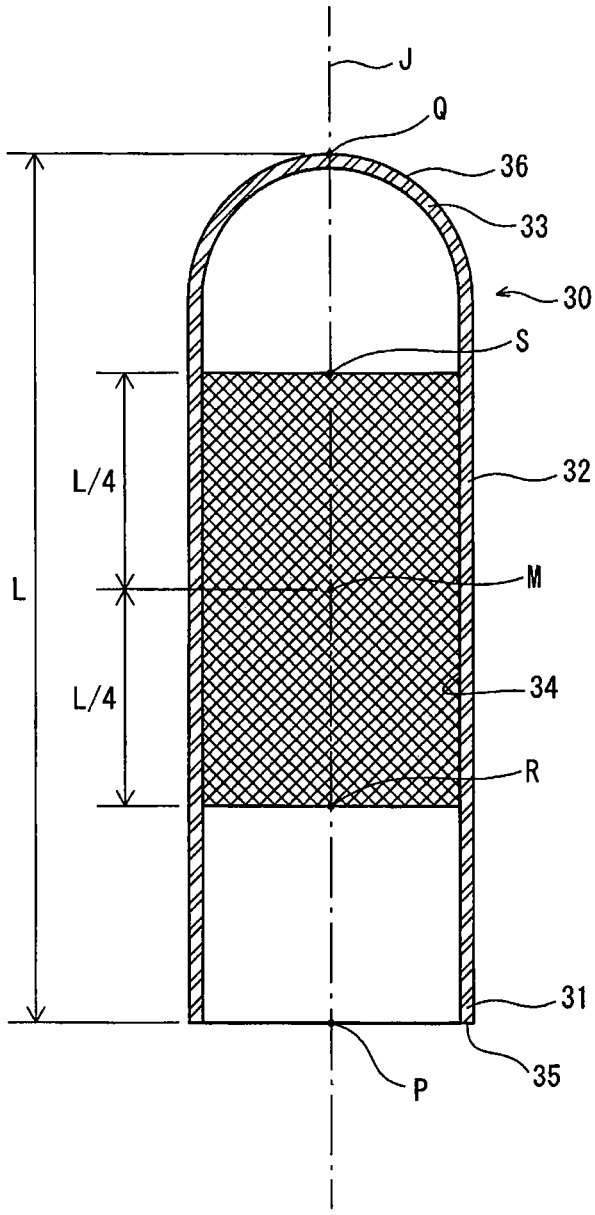
FIG. 3 is a view illustrating the axial center of an outer tube and an axially central section of the outer tube.

FIG. 3 is a view illustrating the axial center and the axially central section of the outer tube. As described above, light guided by the light guide 80 is released from the wavelength converter 90. In addition, most of light released from the wavelength converter 90 travels toward the reflecting mirror 50 and is reflected back toward the wavelength converter 90 to be released from the wavelength converter 90 again. Therefore, the center of the wavelength converter 90 becomes the optical center of the lamp. The wavelength converter 90 is disposed in the axially central section of the outer tube 30 in a manner that the center 0 (see FIG. 1) of the wavelength converter 90 which therefore is the optical center of the lamp 1 coincides with the center M (see FIG. 3) of the outer tube 30. In this embodiment, the lamp axis Z coincides with the tube axis J of the outer tube 30.

Note that the center M of the outer tube 30 is a midpoint between Points P and Q, where P denotes an intersection point of the tube axis J of the outer tube 30 and the plane containing the open end 35 of the outer tube 30, and Q denotes an intersection point of the tube axis J and the topmost point 36 of the top portion 33. In addition, the axially central section of the outer tube 30 refers to a section between Points R and S (crosshatched area in FIG. 3), where L denotes the length of the outer tube 30 (equal to the distance between Points P and Q), and then each of Points R and Sis 25% of the distance L (i.e., L/4) away from the center M along the tube axis J toward Points P and Q, respectively.

Note that the center 0 of the wavelength converter 90 is not required to coincide with the center M of the outer tube 30. Yet, the positional relation should preferably satisfy the condition that at least the center 0 of the wavelength converter 90 is located within the axially central section of the outer tube 30, and more preferably satisfy the condition that the reflecting mirror 50 is also located within the axially central section of the outer tube 30.

[Heat Dissipation Path]

Owing to the structure described above, the lamp 1 according to the present embodiment makes it possible to employ a larger number of LEDs 12 or a higher electric current. When a larger number of LEDs 12 is employed or a higher electric current is supplied to the LEDs 12, the amount of heat generated by the LED module 10 increases and the heat is transferred to the lighting fixture through the base 60. In the present embodiment, however, the circuit unit 40 is not located between the LED module 10 and the base 60, so that the distance between the LED module 10 and the base 60 may be configured to be shorter to allow more heat to be transferred from the LED module 10 to the base 60.

Note, in addition, that some heat generated by the LEDs 12 may remain within the LED module 10 and mount 20 without being transferred to the base 20, which causes the temperature of the LED module 10 and the mount 20 to elevate. Even so, heat load imposed on the circuit unit 40 is ultimately small, since the circuit unit 40 is housed in the outer tube 30 at a location opposite to the LED module 10 across the base 60.

As described above, the lamp 1 according to the present invention is configured so that heat load imposed on the circuit unit 40 does not increase even if the temperature of the LED module 10 and the mount 20 elevates. Therefore, it is not necessary to provide heat dissipating means, such as a heat sink, for lowering the temperature of the LED module 10 and mount 20, which is advantageous for preventing upsizing of the lamp 1.

In addition, by housing the circuit unit 40 in the outer tube 30, it is no longer necessary to secure space for accommodating the circuit unit 40 between the LED module 10 and the base 60. Consequently, the mount 20 of a smaller size may be usable. The mount 20 on which the LED module 10 is mounted undergoes a temperature rise. However, since the circuit unit 40 is not located between the LED module 10 and the base 60, it is not required to intentionally reduce the temperature of the mount LED module 10 and the mount 20.

[Other]

According to the present embodiment, since the circuit unit 40 is housed inside the outer tube 30, no space needs to be secured for accommodating the circuit unit 40 between the mount 20 and the base 60. Therefore, the mount 20 of a smaller size may be used, which is advantageous to configure the lamp 1 into the shape and dimensions similar to HID lamps. The above advantages help to improve the percentage of the lamps 1 according to the present embodiment to be fit to conventional lighting fixtures. In addition, with the use of the mount 20 of a smaller size, the outer tube 30 of a larger size can be used so that sufficient space for housing the circuit unit 40 can be made available inside the outer tube 30.

<Modification 1-1>

The following describes a modification according to which the reflecting mirror has a different shape.

Figure 4:
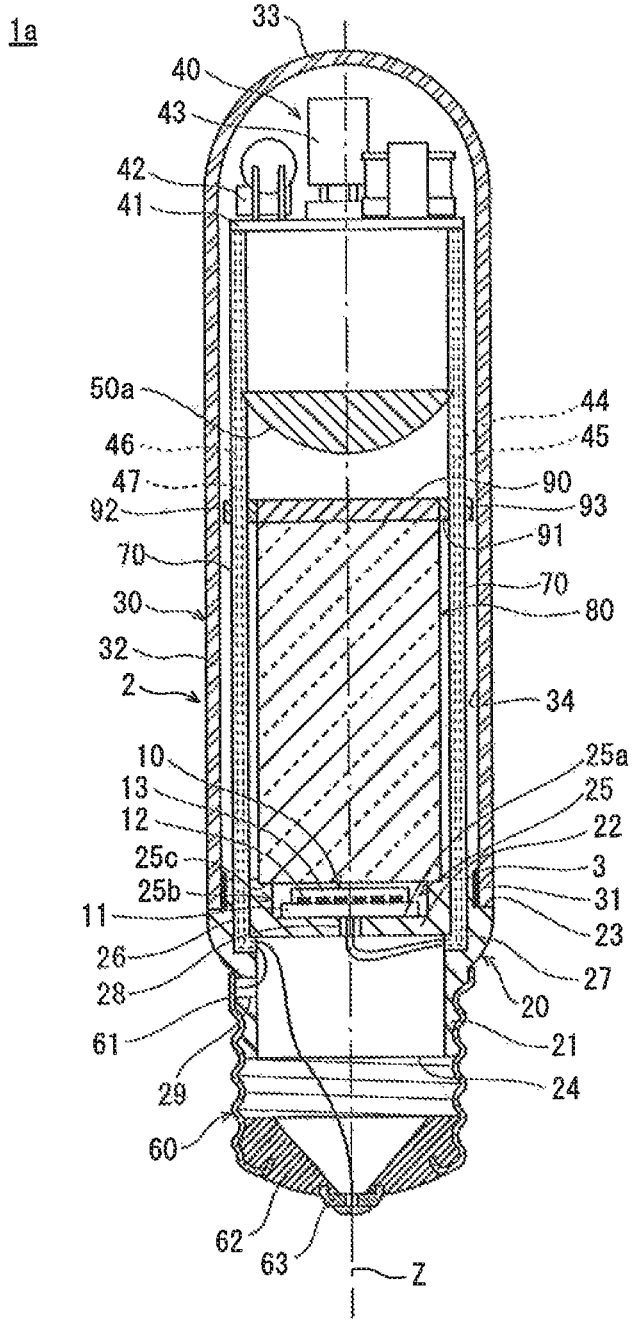
FIG. 4 is a cross-sectional view showing a structure of an LED lamp according to Modification 1-1.

FIG. 4 is a cross-sectional view showing a structure of an LED lamp according to Modification 1-1. The lamp of Modification 1-1 differs from the LED lamp 1 shown in FIG. 1, with respect to the shape of the reflecting mirror 50*a*. More specifically, although the reflecting surface 51 of the reflecting mirror 50 shown in FIG. 1 has a concave surface, the reflecting surface according to Modification 1-1 is a hemispherical shape.

As stated above, with the reflecting mirror having a spherical reflecting surface, most of light reached the reflecting mirror is reflected back toward the wavelength converter 90. It should be noted here that although light reflected from the reflecting mirror 50 and reached the wavelength converter 90 duly undergoes wavelength conversion, some of reflected light still passes through the wavelength converter 90 toward the LED module. Light having passed the wavelength converter 90 is absorbed by the mounting substrate 11 of the LED module and not released from the outer tube 30.

As described above, in addition, light having been undergone wavelength conversion is diffusely scattered inside the wavelength converter 90 and emitted to the outside the wavelength converter 90. Naturally, at least part of such light is emitted toward the LED module. Light emitted toward the LED module ends up being absorbed by the mounting substrate 11 as described above.

In contrast, the reflecting mirror 50*a* of the LED lamp 1*a* according to Modification 1-1 has a hemispherical reflecting surface. Therefore, light emitted from the wavelength converter 90 is reflected toward the wavelength converter 90 and also toward the outside the outer tube 30.

According to this modification, some of light reflected from the reflecting mirror 50*a* travels directly toward the outside the outer tube 30, while some of the light reflected from the reflecting mirror 50*a* travels toward the wavelength converter 90. As a result, the amount of light emitted to the outside of the outer tube 30 is increased to further increase the intensity of the lamp.

Embodiment 2

Figure 5:
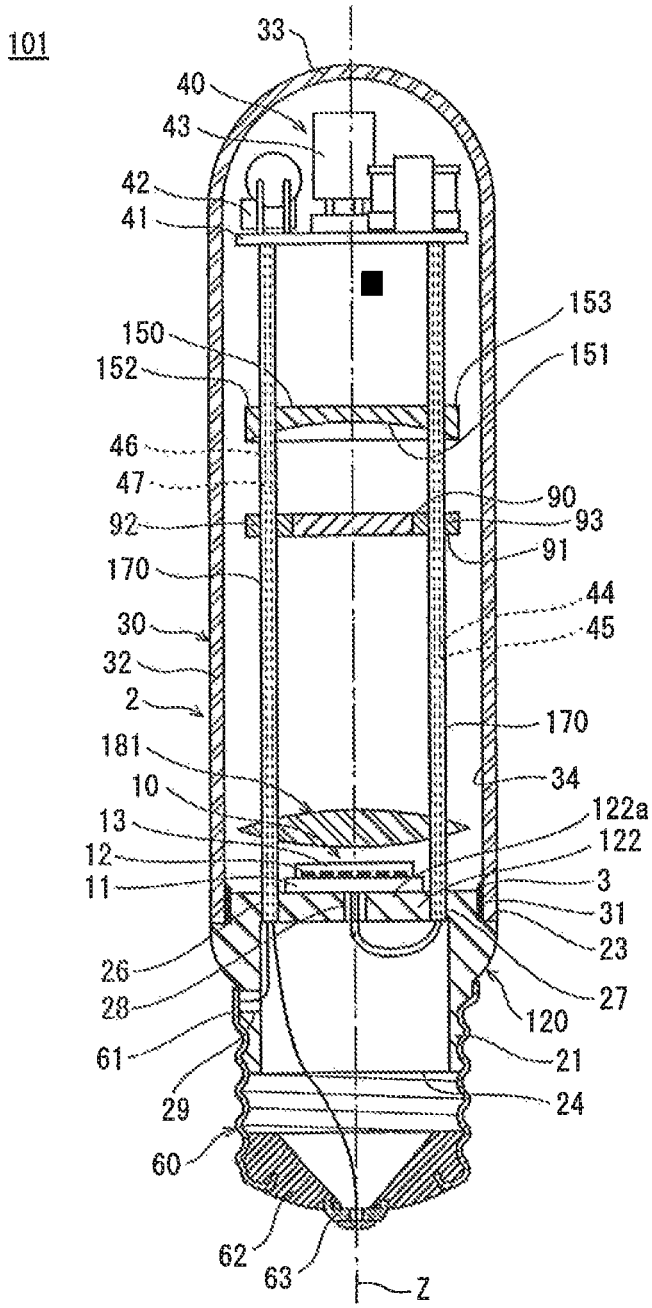
FIG. 5 is a cross-sectional view showing a structure of an LED lamp according to Embodiment 2.

FIG. 5 is a cross-sectional view of an LED lamp 101 according to Embodiment 2. The LED lamp 101 according to this embodiment has basically the same structure as that of the LED lamp 1 according to Embodiment 1, except for the shape of the mount 120 and the optical component used. Therefore, of the components shown in FIG. 5, no description is given of those identical to the components of the LED lamp 1 according to Embodiment 1, while the following mainly describes the different components.

The mount 120 of the present embodiment differs from the mount 20 of Embodiment 1 in that the LED module 10 is mounted on a main surface 120*a* of the closure 122 facing toward the circuit unit 40.

Further, the reflecting mirror 150 according to the present embodiment has through holes 152 and 153. The supports 170 are inserted into the respective through holes 152 and 153 and fixed therein by adhesive, so that the reflecting mirror 150 is attached to the supports 170.

Still further, while the optical component used in Embodiment 1 is the light guide 80, the optical component used in Embodiment 2 is a lens 181 for collecting light emitted from the LED module to the wavelength converter.

The lens 181 is a lens for collecting light emitted from the LED module 10 to the wavelength converter 90. In the present embodiment, the lens 181 is a biconvex lens. The lens 181 collimates light from the LED module 10 into parallel rays of light that travels along the lamp axis Z. Note that the lens 181 is not limited to a biconvex lens and may alternatively be a planoconvex lens. Further, the lens 181 is not limited to a collimating lens that collimates light from the LED module 10 into parallel light that travels along the amp axis Z. Alternatively, any lens that collects light onto the wavelength converter 90 is usable.

As described above, with the use of the lens 181 as an optical component, light emitted from the LED module 10 is appropriately guided to the wavelength converter 90.

<Modification 2-1 >

The following describes a modification according to which the reflecting mirror has a different shape.

Figure 6:
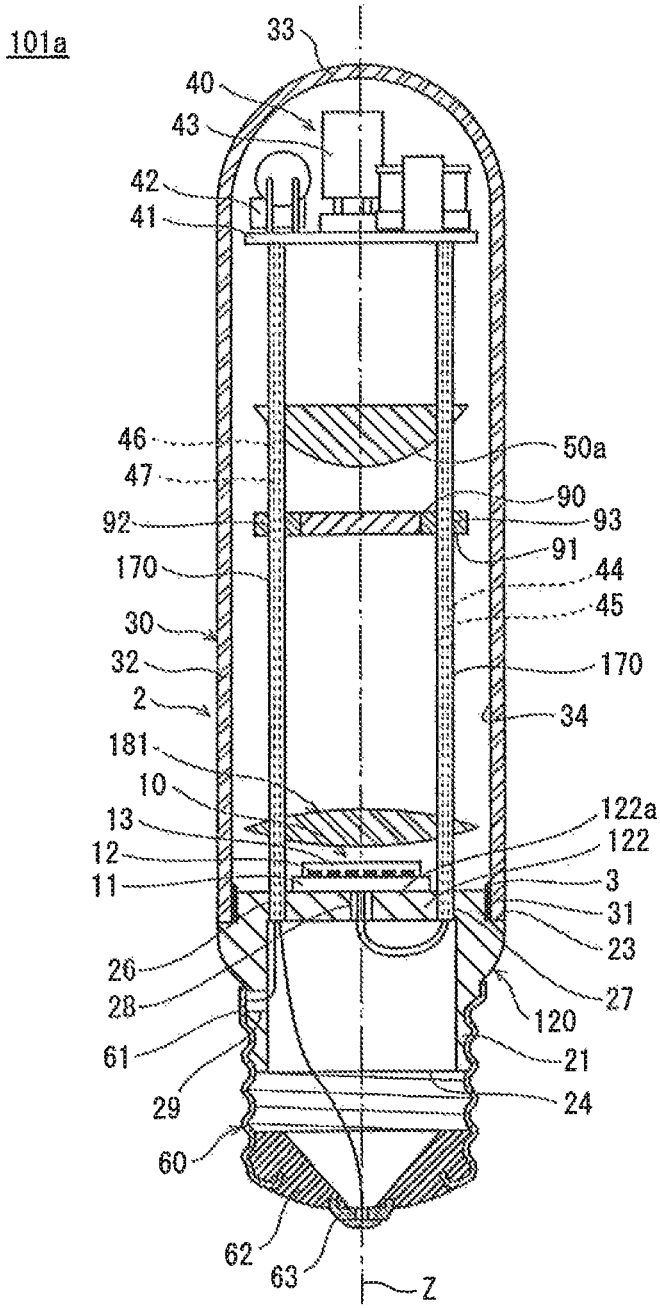
FIG. 6 is a cross-sectional view showing a structure of an LED lamp according to Modification 2-1.

FIG. 6 is a cross-sectional view showing a structure of an LED lamp 101*a* according to Modification 2-1. The lamp 101*a* of Modification 2-1 differs from the LED lamp 101 shown in FIG. 5, with respect to the shape of the reflecting mirror. More specifically, although the reflecting surface 151 of the reflecting mirror 150 shown in FIG. 5 has a concave surface, the reflecting surface according to Modification 2-1 is a hemispherical shape.

Note that the advantages obtained through the use of a reflecting mirror having a hemispherical reflecting surface have been already described in Modification 1-1, and thus no further description is given here.

<Supplemental>

Up to this point, the LED lamp according to the present invention has been described by way of the above embodiments and modifications. It is naturally appreciated, however, that the present invention is not limited to those described above.

1. Base

According to the above embodiments and modifications, the base and mount are hollow bodies. However, the internal space may be filled with an insulating material having a higher conductivity than air. This modification helps heat generated by the LED module during the operation to be conducted to the lighting fixture via the base and the socket. This improves the total heat dissipation of the lamp. One example of the insulating material is a silicone resin.

2. LED Module (1) Mounting Substrate

Existing mounting substrates, such as a resin substrate, a ceramic substrate, a metal-based substrate composed of a resin plate and a metal plate, or the like may be used as the mounting substrate.

(2) LED

According to the above embodiments and modifications, blue LEDs are used. Alternatively, however, LEDs that emit light of another color may be used. In one example, the LEDs mounted on the LED module 10 may be ultraviolet LEDs. In that case, the wavelength converter 90 should be made of a translucent material containing phosphor particles of R, G, and B.

(3) Sealer

The sealer is described as covering all the LEDs mounted on the mounting substrate. However, a single LED may be covered with a single piece of sealer, or the LEDs may be grouped and a predetermined number of LEDs may be covered with a single piece of sealer.

3. Plate

According to the above embodiments and modifications, the plate 91 is a plate surrounding an opening, and the wavelength converter 90 is fitted within the opening. Alternatively, however, the plate may be a plate (of a disk shape, for example) without opening and the surface of the plate facing toward the light guide may be coated with a wavelength converting layer formed of a wavelength converting material.

Alternatively to providing the wavelength converting layer on the surface of the plate facing toward the light guide, the plate itself may contain a wavelength converting material. This is done by mixing a wavelength converting material into raw materials for the plate.

4. Wavelength Converter

According to the above embodiments and modification, the wavelength converter 90 is fitted into the opening of the plate 91 and fixed therein. Alternatively, however, the wavelength converter 90 may be secured on the light guide without the plate 91 therebetween. The wavelength converter may be secured by using, for example, a transparent adhesive.

5 Reflecting Mirror

According to the above embodiments and modifications, the reflecting surface 51 of the reflecting mirror is a concave spherical surface or a hemispherical surface. However, the external shape of the reflecting mirror is not limited to those specifically described above. As long as the reflecting mirror is capable of reflecting at least part of light received thereby toward the wavelength converter, any other shape is applicable.

For example, the reflecting mirror may have the shape of a regular polyhedron other than a regular tetrahedron, a regular hexahedron, a regular octahedron, a regular dodecahedron or a regular icosahedron. Further, the reflecting mirror is not limited to a regular polyhedron and may alternatively have the shape of a semi-regular polyhedron, such as a truncated tetrahedron, a truncated hexahedron, a truncated octahedron, a truncated dodecahedron, a truncated icosahedron, a rhombicosidodecahedron, a rhombitruncated cuboctahedron, a rhombitruncated icosidodecahedron, a rhombicbooctahedron, a snub cube or a snub dodecahedron.

Still further, the reflecting mirror is not limited to a semi-regular polyhedron and may alternatively have the shape of a regular polyhedron, such as a regular tetrahedron, a regular hexahedron, a regular octahedron, a regular dodecahedron or a regular icosahedron. Still further, the reflecting mirror may alternatively have the shape of a quasi-regular polyhedron, such as a cuboctahedron, an icosidiodecaherdon, a dodecadodecahedron, a great icosidodecahedron, a small ditrigonal icosidodecahedron, a ditrigonal dodecadodecahedron, a great ditrigonal icosidodecahedron, a tetrahemihexahedron, an octahemioctahedron, a cubohemioctahedron, or a small icosihemidodecahedron.

Still further, the reflecting mirror may alternatively have the shape of a regular star polyhedron, such as a small stellated dodecahedron, a great dodecahedron, a great stellated dodecahedron, or a great icosahedron. Still further, the reflecting mirror may alternatively have the shape of a uniform polyhedron, such as a small cubicuboctahedron, a great cubicuboctahedron, a cubitruncated cuboctahedron, a uniform great rhombicuboctahedron, a small rhombihexahedron, a great truncated cuboctahedron, a great rhombihexahedron, a small icosicosidodecahedron, a small snub icosicosidodecahedron, a small dodecicosidodecahedron, a truncated great dodecahedron, a rhombidodecadodecahedron, a truncated great icosahedron, a small stellated truncated dodecahedron, a great stellated truncated dodecahedron, a great dirhombicosidodecahedron, or a great disnub dirhombidodecahedron.

Still further, the reflecting mirror may alternatively have the shape of an Archimedean dual, a deltahedron, a Johnson solid, a stellation, a zonohedron, a parallelohedron, a rhombohedron, a polyhedral compound, a compound, a perforated polyhedron, Leonardo da Vinci's polyhedra, a ring of regular tetrahedra, and a regular skew polyhedron.

6. Circuit Unit

According to the above embodiments and modifications, the circuit unit has a plurality of electronic components mounted on a single circuit substrate and the entire circuit unit is disposed at a location opposite the LED module 10 with respect to the wavelength converter 90. However, one or more components of the circuit unit may be disposed at a different location. For example, the circuit unit may have two circuit boards and the electronic components are mounted separately on the two circuit substrates. One of the circuit substrates and the electronic components mounted thereon may be disposed at a location opposite the LED module 10 with respect to the wavelength converter 90, whereas the other circuit substrate and the electronic components mounted thereon are disposed at a different location. This modification eliminates the need to dispose all the electronic components within the outer tube. For example, electronic components relatively resistant to heat may be disposed at a location between the LED module and the remote end of the base from the LED module. With the above modification, the circuit unit to be housed in the outer tube can be minimized by the volume of the electronic components disposed at a location between the LED module and the base, According to the above embodiments and modifications, the circuit substrate of the circuit unit is oriented so that the main surface thereof is orthogonal to the lamp axis Z. Alternatively, however, the circuit substrate may be oriented so that the main surface thereof is parallel to the lamp axis Z or inclined with respect to the lamp axis Z.

[Other]

In the above embodiments and modifications, the supports 70 function as heat dissipating means. Additionally to the supports 70, a heat pipe may be provided to connect the circuit unit and the base for transferring heat from the circuit unit to the base. For example, a rod-like heat pipe made of material having a high thermal conductivity may be disposed between the circuit unit and the base in manner that the heat pipe is thermally connected at one end to the circuit unit and to the base at the other end. In this modification, it is preferable to provide electrical isolation to ensure that no current flows between the circuit unit and the base via the heat pipe.

INDUSTRIAL APPLICABILITY

The present invention is applicable for the miniaturization of LED lamps and the improvement in lamp intensity.

The invention claimed is:

1. A lamp including a semiconductor light-emitting element as a light source, a circuit unit configured to cause the semiconductor light-emitting element to emit light, and an envelope having an outer tube and a base, the semiconductor light-emitting element and the circuit unit being housed in the envelope, the lamp comprising:

a wavelength converter disposed in an axially central section of the outer tube and configured to convert wavelengths of light incident thereto, the semiconductor light-emitting element being disposed in a region at a side of the wavelength converter facing the base and oriented so that a main, emission direction points away from the base;

an optical component disposed between the wavelength converter and the semiconductor light-emitting element and configured to guide emission light of the semiconductor light-emitting element to the wavelength converter; and a reflecting mirror configured to reflect light, wherein at least one component of the circuit unit is disposed in a region at a side of the wavelength converter opposite the semiconductor light-emitting element, and the reflecting mirror is disposed between the at least one component of the circuit unit and the wavelength guide and reflects light received from the wavelength converter back toward the wavelength converter.

2. The lamp according to claim 1, wherein the optical component is a lens configured to collect emission light of the semiconductor light-emitting element onto the wavelength converter.

3. The lamp according to claim 1, wherein the at least one component of the circuit unit is disposed in the region at the side of the wave coverer opposite the semiconductor light-emitting element, and all other components of the circuit unit are disposed between the base and the semiconductor light-emitting element.

4. The lamp according to claim 1, wherein the optical component is a columnar light guide having an entrance portion for light emitted by the semiconductor light-emitting element to enter, the entrance portion facing an exit portion of the semiconductor light-emitting element.

5. The lamp according to claim 4, wherein the at least one component of the circuit unit is disposed in the region at the side of the wave coverer opposite the semiconductor light-emitting element, and all other components of the circuit unit are disposed between the base and the semiconductor light-emitting element.

6. The lamp according to claim 1, further comprising:

a mount disposed at an open end of the base, the semiconductor light-emitting element being mounted on the mount;

a tubular support attached at one end to the mount so as to support the at least one component of the circuit unit; and electrical wiring lines, one of which connects the semiconductor light-emitting element to the at least one component of the circuit unit and another of which connects the base to the at least one component of the circuit unit, each electrical wiring line extending through an interior passage of the support.

7. The lamp according to claim 6, further comprising:

a plate made of a translucent material and surrounding an opening substantially at a center of the plate, wherein the wavelength converter is attached within the opening.

8. The lamp according to claim 7, wherein the support additionally supports the reflecting mirror.

* * * * *